United States Patent [19]

Greer et al.

[11] Patent Number: 4,739,655

[45] Date of Patent: Apr. 26, 1988

[54] METHOD OF AUTOMATICALLY DETERMINING DRILLING FLUID LAG TIME WHILE DRILLING A WELL

[75] Inventors: Carl T. Greer, Houston; Clarence F. Ryan, Bellaire; Mark H. Blankenship, Houston, all of Tex.

[73] Assignee: Precision Well Logging, Inc., Houston, Tex.

[21] Appl. No.: 3,353

[22] Filed: Jan. 14, 1987

[51] Int. Cl.[4] ..... E21B 47/00

[52] U.S. Cl. ..... 73/155; 73/153

[58] Field of Search ..... 73/155, 152, 153; 364/422

[56] References Cited

U.S. PATENT DOCUMENTS

| | | | |
|---|---|---|---|
| 2,414,246 | 1/1947 | Smith | 73/153 |
| 2,658,725 | 11/1953 | Arps . | |
| 2,659,046 | 11/1953 | Arps . | |
| 2,806,372 | 9/1957 | Arps | 73/151.5 |
| 2,925,251 | 2/1960 | Arps . | |
| 3,155,176 | 11/1964 | Bennett | 175/42 |
| 3,324,717 | 6/1967 | Brooks et al. | 73/152 |
| 3,386,286 | 6/1968 | Moore | 73/153 |
| 3,462,761 | 8/1969 | Hareth et al. | 346/1 |
| 3,512,164 | 5/1970 | Bynum | 346/1 |
| 3,750,766 | 8/1973 | Thompson et al. | 175/50 |
| 3,982,432 | 9/1976 | Hammond | 73/151.5 |
| 4,295,366 | 10/1981 | Gibson et al. | 73/155 |
| 4,326,411 | 4/1982 | Gant et al. | 73/155 |
| 4,401,169 | 8/1983 | Neshyba | 175/42 |
| 4,507,735 | 3/1985 | Moorehead et al. | 364/422 |
| 4,535,851 | 8/1985 | Kirkpatrick et al. | 175/38 |

*Primary Examiner*—Jerry W. Myracle

*Attorney, Agent, or Firm*—Fulbright & Jaworski

[57] ABSTRACT

A continuously adjusted calculated annulus drilling fluid lag time while drilling oil and gas wells and analyzing the drilling mud at the well surface for formation gas, fluids and rock in order to accurately index the release of the formation gas, fluids and rock released by the drill bit with the depth at which they were released. The method obtains such analyses by using a computer and pumping pressure to accurately track the drilling mud time lag and automatically adjusts for variations in the annulus flow rate to correlate the recorded data with its originating depth.

5 Claims, 4 Drawing Sheets

PLOTTED FOR:
DEPTH: 7000 FEET
HOLE DIA: 8 3/4"
O. DIA DRILL PIPE: 16 LBS/FT
PUMP LINER SIZE: 7 1/4"×20"
BIT JET SIZES: 20/32" (3)

| ANNULAR VEL. (FT./MIN) | PUMP RATE (STKS/MIN.) | LAG (MINUTES) |
|---|---|---|
| 79 | 15 | 88 |
| 122 | 23 | 57 |
| 159 | 30 | 44 |
| 250 | 45 | 28 |
| 318 | 60 | 22 |

TABLE DEVELOPED TO LOAD INTO PROGRAM

| PSI PRESSURE: | FT./MIN FLOW: | TIME BASE FACTOR |
|---|---|---|
| 115 | 79 | 2.00 |
| 420 | 122 | 1.30 |
| 700 | 159 | 1.00 |
| 1500 | 250 | 0.64 |
| 2600 | 318 | 0.50 |

METHOD OF AUTOMATICALLY DETERMINING DRILLING FLUID LAG TIME WHILE DRILLING A WELL

BACKGROUND OF THE INVENTION

In the rotary drilling for oil and gas a drilling fluid is pumped down the drill pipe, out the drill bit, and up the annulus between the outside of the drill pipe and the drilled bore. The drilled fluid is examined at the well surface for gas, fluids and rock particles and are important in evaluating the possibilities of the subsurface formations for the production of oil and gas. However, it is critical to know the well depth from which the gas, fluids and rock were released by the drill bit. Therefore, a procedure has been employed to determine the lag time or delay interval between the time of the release of cuttings from the bottom of the well hole until they were pumped to the well surface for examination. By knowing the lag time, the annulus flow velocity and thus the depth of release could be calculated. The lag time is determined by pumping a "marker" (oats, carbide, etc. which could be identified by its appearance at the surface) down the interior of the drill pipe and back through the annulus to be observed, and identified at the surface. Time in minutes or pump strokes were used as a measure. This measurement included both dow pipe strokes or minutes (the passage of mud fluid down the interior of the drill pipe) and the "lag" (the passage of the mud fluid from the bottom to the surface in the annulus). Knowing the internal volume of the drill pipe, the down pipe strokes or minutes were calculated and then subtracted from the total circulation to obtain the lag from the bottom to the surface. The use of pump strokes meausrements was more accurate, since variations in pumping speed directly related to variations in the lag. Once a measurement in pump strokes was obtained the speed of the pump was irrelevant. However, a time base lag was inaccurate because it would not adjust to variable flow rates. Of course, as the depth of the bore hole increases both methods become inaccurate.

These methods above have been used with very few changes to the present. They are simple, easy to use, and the pump stroke counting switches and meters to count and keep totals are inexpensive. But the successful operation of the entire system was dependent upon the full-time presence of an observer-operator (mud logger). Two or three drilling mud pumps outputting different volumes per stroke pumped required the mud logger to calculate a lag for and switch counting instruments to each pump or combination of pumps used while drilling. In practice, this manual procedure has not been difficult but automatic switching of this sort would be very difficult, requiring considerable instrumentation.

Recently, industry efforts to develop an automatic, on-line, real time computerized mud logging system with the capability of gathering, storing and graphically presenting rate of penetration with mud gas accurately positioned to depth, all in an unattended situation, have had very limited success. The best efforts have been the pump stroke method which required elaborate expensive auto-switching instrumentation and the involvement of the driller or another rig crew member to keep the pump stroke counters operating and to route the proper counter(s) to the computer. Other efforts merely use a straight time lag which does not adjust for mud flow stoppages or variations. Elaborate auto-switching instrumentation on rig pumps introduces increased likelihood of equipment malfunction, and perhaps more important, the use of rig personnel in performing the switching is very unreliable.

SUMMARY

The present new method makes use of the relationship between mud flow rate (annular velocity) and pump pressure as a basis of computing lag. A computer is used for the entire integrated system of gathering logging data, storing it on a disc and presenting it tabularly and graphically on a screen and hard print.

Further, in accordance with this invention, in place of continuously using impulse switches on the drilling rig pumps for monitoring pump strokes or using straight time, a pumping pressure transducer sensing device to monitor mud pressure is inserted into the common pump output mud flow system. This pressure data is brought into the computer interface on a continuous basis. To accurately correlate logging data, the method incorporates a current lag, and effects adjustments of the lag time for continuously changing mud flow rate (annular velocity) in the well.

To begin, the operator obtains a lag in minutes using the standard circulated "marker" method. The pump strokes and pump pressure are observed while the "marker" is being circulated to establish a relationship between these and the calculated lag minutes and flowrate (annular vertical ft/min). This relationship is used with the pump pressure and strokes observed at other slower and faster rates. This establishes several points over the entire pumping range of that well, and is entered into a program logic as a table of pump pressure psi and annular flow rate ft/min. Data in this program table enables a computer logic to automatically adjust lag variations across the entire pumping pressure range and interpolating infinitely between these observed points. The annular flow rates for the additional pressures observed are calculated by determining the total pump output (unit vol/min) divided by annular volume (unit vol/100 ft). A table, preferably with at least five levels of pressure and annular flow rates, permits the program to continuously adjust lag by applying the table derived time base deviation to fluctuating pressures measured by the mud pressure sensor. This computerized method greatly simplifies all calculations of various phenomenon acting within the mud pumping system. Thus, further calculation of mud flow properties, hydraulics, pressure drops, etc., is unnecessary at that point.

The present invention is directed to a method of automatically determining drilling fluid lag time while drilling a well in which drilling fluid is pumped down the drill pipe, out of the drill bit and up the annulus by measuring the lag time, by inserting a marker in the drill pipe, and deriving a relationship between pump strokes, pump pressure and annular velocity at the then normal drilling condition. A relationship between pump pressure and lag time over a range of pump pressures is also determined by measuring the pump strokes and pump pressures at a plurality of different pump strokes and calculating the lag time at the measured values by use of equivalent annular velocities obtained. Thereafter, the pump pressure is continuously measured while drilling and the lag time is computer calculated from the relationship previously determined. In addition, the method includes measuring the depth of the drill bit and using the change in the depth measurement for adjusting the calculated lag time. The method also includes measuring a parameter such as gas, rock cuttings, formation fluids of the drilling fluid flowing out of the annulus and correlating the measured mud parameter with the calculated lag time thereby determining the depth from which the measured mud parameter originated.

The method of the present invention also includes repeating the above-named steps to determine a new relationship between pump pressure and lag time each time well drilling conditions change sufficiently to obsolete the earlier determined relationship.

Another object is wherein the measurement of a parameter of the drilling fluid includes measuring the amount of formation gas in the drilling fluid.

Still a further object of the present invention is wherein a base lag time is determined for one of the lag measurements and the other lag time measurements for different values of pump pressure are converted to a factor of the base lag time for providing an input to a computer.

Other and further objects, features and advantages will be apparent from the following description of a presently preferred embodiment of the invention, given for the purpose of disclosure and taken in conjunction with the accompanying drawings.

DESCRIPTION OF THE PREFERRED EMBODIMENT

Figure 1:
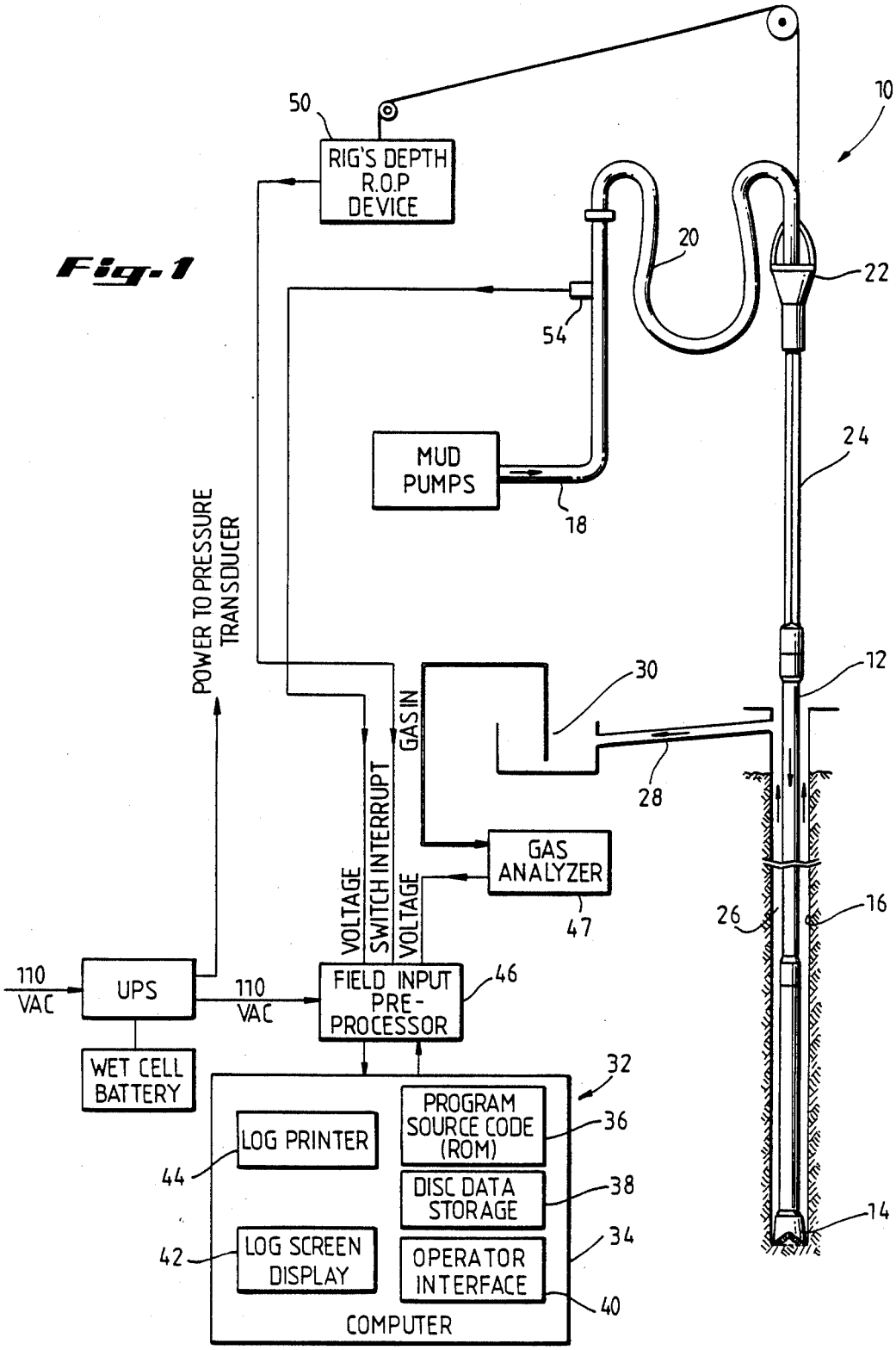
FIG. 1 is an electrical and mechanical schematic of the use of the present invention with a conventional rotary drilling rig.

Referring now to FIG. 1, a partial schematic of a rotary drilling rig 10 is best seen in which a drill pipe 12 includes a bit 14 drilling a bore hole 16. Drilling fluid or mud is pumped through a pump discharge line 18 by one or more mud pumps (not shown) through a rotary hose 20, a swivel 22, a kelly joint 24, down the interior of the drill pipe 12, out the bit 14 and up the annulus 26 between the drill pipe 12 and bore hole 16 to a mud return line 28. At the well surface various characteristics of the return drilling fluid can be observed or measured such as the presence of formation gas, fluids and rock. For example, conventional gas extraction equipment 30 may be used for liberating gas in the return drilling fluid, to be drawn into the gas analyzer 47.

Referring still to FIG. 1, an electronic measuring and calculating circuit is generally indicated by the reference numeral 32 and includes a computer 34 such as sold by Hewlett-Packard, Model No. 9807A (Integral Personal Computer). The computer 34 includes a program source code 36, data storage 38, an operator interface 40, a screen display 42, and a printer 44. A field input pre-processor 46 is connected between the computer 34 for acquiring data relating to the drilling fluid such as a gas analyzer 47 which is connected to the gas extracter 30, a depth and drilling rate input from a rig depth and rate of penetration measuring device 50, and a pump pressure from a pumping pressure sensor 54, which in turn is connected to the output of the mud pumps. Therefore, the circuit 32 measures the pressure at the output of the mud pumps, uses the relationship between the pump pressure and annulus flow velocity for computing the lag and thus the depth at which the surface mud measurements originated.

Figure 2:
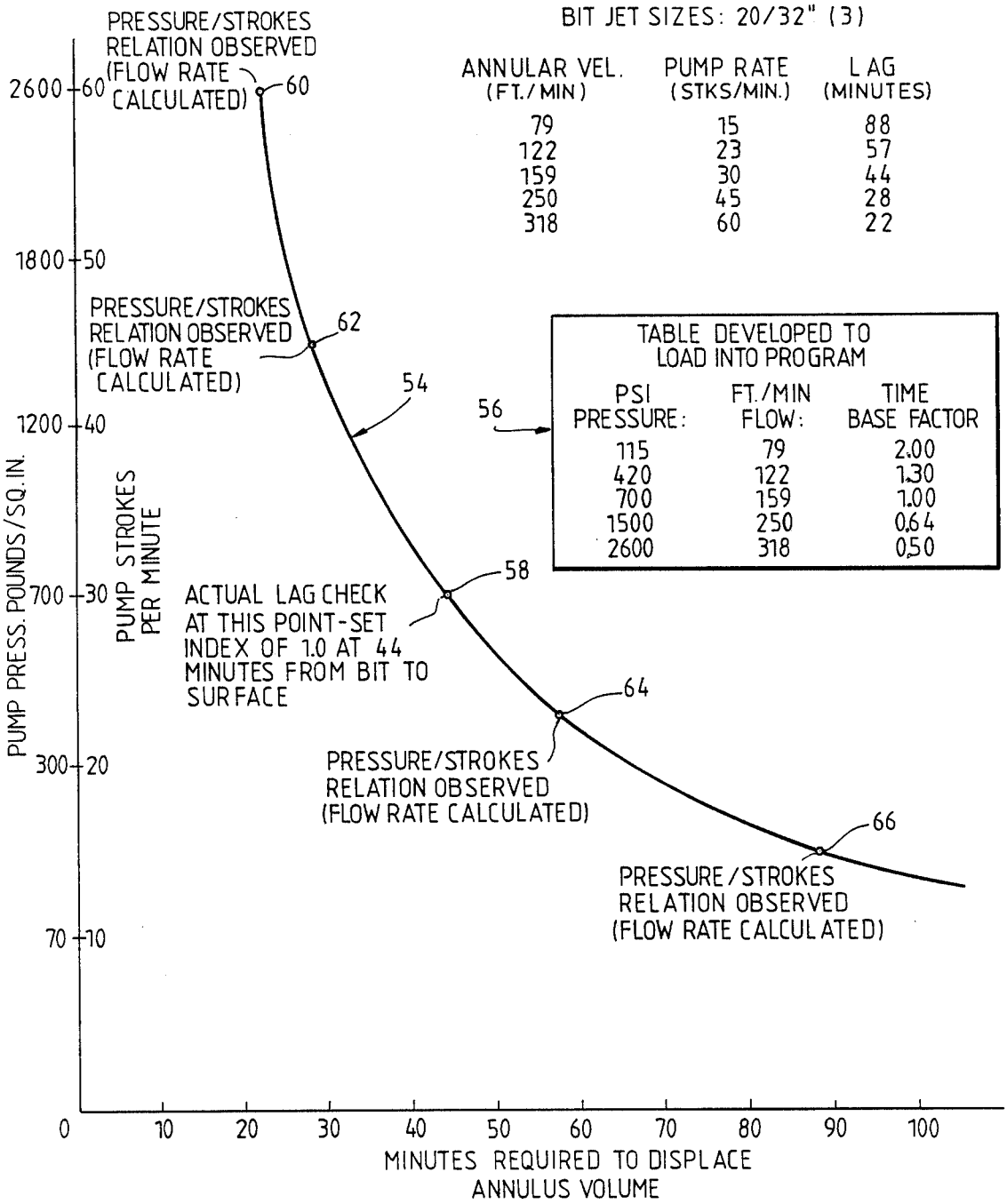
FIG. 2 is a graph and table showing the method of determining a relationship between pump pressure and lag time for the particular set of drilling parameters noted.

Referring now to FIG. 2, a curve 54 is shown along with a table 56 which is developed for the particular well parameters noted. This information is then loaded into the program of the computer 34 for continuously computing the lag time until well conditions significantly change.

At the beginning of the operation of any particular well, the operator runs an actual lag with a marker as previously described. The number of minutes required to pump from the bit 14 to the surface is ascertained, simultaneously recording the pump speed (strokes/minutes) and the pump pressure (psi) to provide a point 58 on the curve 54. Using the lag minutes and the well depth, he obtains the overall annulus velocity (flow rate in feet/minute). The annular volume is calculated using the observed strokes per minute converted to pump output in gallons/minute multiplied by lag time Then, the mud pumps are manipulated to provide different pump pressure and pump speeds, preferably at two points 60 and 62 above the actual lag check point 58 and two points 64 and 66 below the actual lag check point 58. Using the information collected as to the volume of the bore hole 16 from the actual lag check point 58 and using pump, pipe, and hole capacity tables, along with the observed pressure and speed measurements at points 60, 62, 64 and 66, the flow rate and lag time is calculated at each of the pressure/strokes at each of the points 60, 62, 64 and 68. Now, the graph 54 and the table 56 provide an indication of the lag time and pump pressure over the entire range of pump pressures that may be utilized. This information is loaded into the program of the computer 34 and the computer 34 is enabled to use fluctuating pump pressures from the pressure sensor 54 to track the annulus velocity and the corresponding lag throughout the full range of drilling fluid movement up the annulus 26. Thus, with each one foot drilling interval, the drilling fluid lag is accurately timed to correspond with the gas, fluids and rock analyzed for that drilling interval.

For the actual lag check point 58 in the example given on FIG. 2, the pressure was 700 psi at thirty pump strokes of "x" gallons per minute giving a lag time of 44 minutes which provided a calculated flow rate of 159 feet per minute. From this, the annular volume can be calculated. Using the measured pressure and strokes at the other points 60, 62, 64 and 66, the flow rate and lag time are calculated in the example shown. The examples of pressure and flow rate were calculated from a low point of 115 psi and 79 feet per minute up to a high point of 2600 psi and 318 feet per minute. The time factor in the table 56 is based upon the actual measured point 58 which had a time lag of 44 minutes. For the interval when the pump pressure was lowered to 420 psi at point 64 the effective lag is 1.3 times 44 minutes or 57 minutes. For the point at which the pump pressure was raised to 1500 psi, the effective lag is 0.64 times 44 minutes or 28 minutes. Thereafter, the program 56 will interpolate infinitely between the points loaded into the table 56. Therefore, during drilling operations, when it is routine to be varying pump pressure due to rig procedures, this method of lagging accurately keeps track of drilled intervals when the mud system annular velocity is rising and falling.

This automatic continuously adjusted drilling fluid lag method using computerized pump pressure is superior to the pump stroke method because (1) Unattended logging situations are more feasible while providing optimum accuracy, (2) Computerized compensation is made of the varying pump pressures, (3) This automatic system is much more hardware (computer and sensors) reliable. (Should the pressure sensor fail, the system automatically shifts to the straight time method until the sensor is repaired.), (4) The compounding effect of combining a Duplex with a Triplex Pump does not affect this new method, and (5) The switching of pumps and combinations of pumps, normally requiring personnel intervention with pump stroke counters in use, does not affect this new method.

However, a new base lag point 58 and graph 54 and table 56 must be created and entered into the computer 34 at any time there is a significant change in any of the parameters which would change the lag time. Normally, a new table 56 is determined when the depth of the bore hole 16 changes depth 200 feet or when other parameters change such as hole size, casing set, a significant change in mud weight or viscosity, bit jet nozzle size change, or diamond bit wear.

Figure 3A:
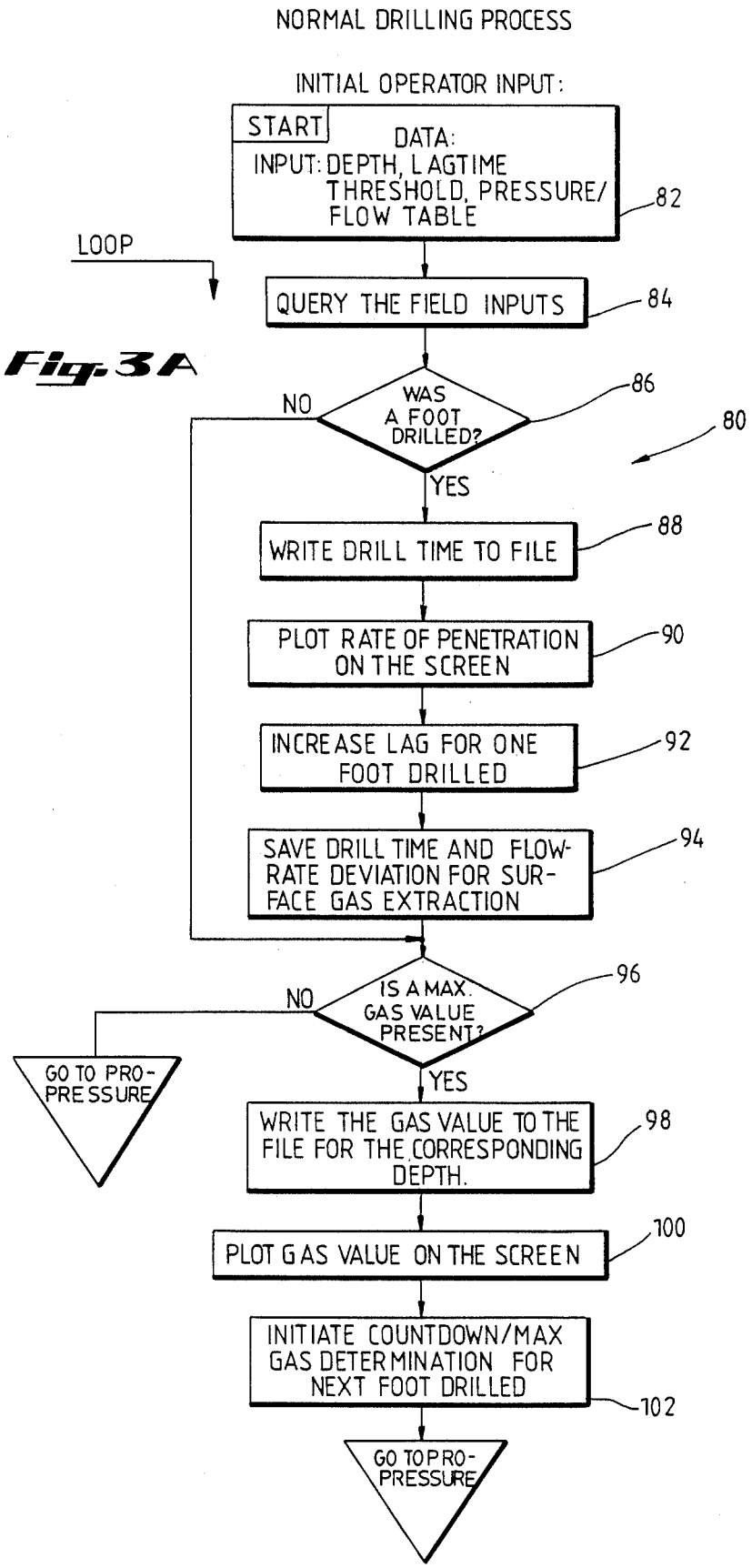
FIGS. 3A and 3B is a logic diagram for performing the method of the present invention
Figure 3B:
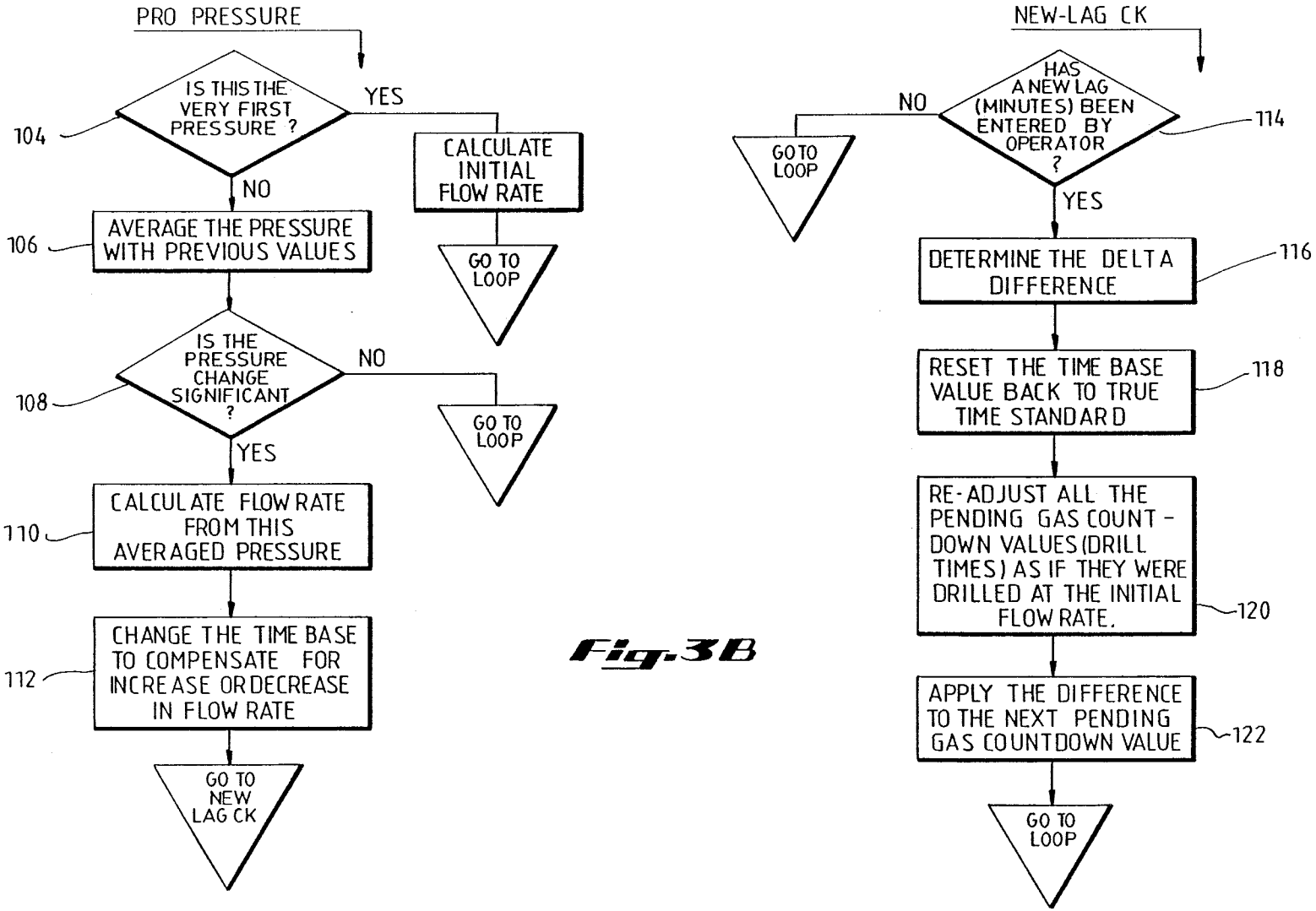

Referring now to FIGS. 3A and 3B, the logic flow diagram is generally indicated by reference numeral 80. At the beginning of the program 82, the operator inputs the initial logging parameters into the computer system, via the operator interface 40. These initial logging parameters include current depth, current lag time, the pressure threshhold and the pressure flow relationship data.

After the one time initial step 82, control passes to the beginning of the main data acquisition loop, step 84, where the field inputs are queried from the field input pre-processor 46. These field inputs are respectively:

fp1—drill time duration for the foot just completed.

fp2—a maximum gas value for a previously drilled column of mud that is transversing past the gas analyzer 47 at the surface.

fp3—the current pressure from the pressure transducer 54.

At step 86, the drill time duration parameter is examined to determine if a foot was just drilled. If a foot was not drilled, control passes to step 96.

After determining that a foot was just drilled control passes to step 88 whre the drill time duration is written to the field data file for later reference. Next, at step 90, the drill time duration is converted to a rate of penetration and is plotted on the display screen 42. Step 92 adds an incremental change to current lag of the well due to the incremental mud volume increase. In step 94 the drill time duration and flow rate deviation (from the initial flow rate) are saved for later correlation with the surface gas extraction.

At step 96, the max gas value parameter is examined to determine if a maximum gas value from a previously drilled column of mud has been extracted. If a max gas value is not present, control passes to step 104. After determining that a maximum gas value is ready for processing, control passes to step 98 where the gas value is written to the field data file for the associated depth. In this step the lag separation will determine how far to index back from the end of the file to address the correct depth. Step 100 plots the gas value on the display screen 42. Step 102 transmits the next pending previously saved drill time duration parameter (see step 94) to the field input pre-processor to start the next maximum gas value extraction process. Control now passes to step 104.

Step 104 begins the pressure processing section of the program by determining if this is the very first pressure queried from the field input pre-processor. If this is the very first pressure then the initial flow rate is calculated from the pressure-flow rate data table 56 and then control passes back to the step 84 (main loop). For subsequent pressures step 106 performs a running average with previous pressure values. Step 108 determines if a significant pressure change has taken place. If there is no significant change then control passes to the main loop, step 84. In step 110 a comparison flow rate is calculated from the running average pressure. Step 112 calculates the flow rate deviation and accordingly changes the time base insde the field input pre-processor 46 (via a special transmission) to compensate for the increase or decrease in flow rate. For example, if the drill time duration for a particular foot was one minute and if the flow rate was increased by 25% then the mud segment for that foot would accelerate from 60 seconds to 45 seconds while passing by the gas extraction point 30. Control now passes to step 114.

From time to time in the drilling process various changing well conditions will cause the lag time to change. These new lag times are entered via the operator interface 40. Step 114 determines if a new lag value has been submitted by the operator. If not, control passes to the main loop, step 84. If a new lag value is present, step 116 calculates the delta difference which will be utilized later in step 122. Step 118 readjusts the time base value in the field input pre-processor 46 (via a special transmission) back to the true time standard; one second equals one second. In step 120 all of the pending previously saved drill time duration values are readjusted as if they were drilled with the initial mud flow rate. The delta difference calculated in step 116 is now applied to the next pending drill time duration value in step 122. Control now passes to the main loop, step 84.

The lag control computer system includes the following important built-in features.

(1) Automatic update of the current lag with each foot drilled to compensate for the incremental increase in mud volume.

(2) An automatic time back-up lag system which is activated upon the detection of a pressure transducer malfunction. In the time back-up mode, special function keys are activated to allow manual operation of the system until the pressure transducer is back on line.

(3) All pending drill time duration and flow rate deviation data are automatically adjusted if a new lag is entered.

(4) Erratic pumping pressures are automatically dampened.

(5) A pumping pressure threshold to stop the upward movement of values (and corresponding parameters of gas, fluids and rock released) during pipe connections and other stoppages, and (6) A maximum gas value for each foot drilled is processed regardless of the original drill time duration and all flow rate deviations up to and including the actual extraction process.

The present invention, therefore, is well adapted to carry out the objects and attain the ends and advantages mentioned as well as others inherent therein. While a presently preferred embodiment of the invention has been given for the purpose of disclosure, numerous changes in the details of construction, arrangement of parts and steps of the method will be readily apparent to those skilled in the art and which are encompassed within the spirit of the invention and the scope of the appended claims.

What is claimed is:

1. The method of automatically determining the lag time for drilling fluid to move through a well annulus while drilling a well in which drilling fluid is pumped down a drill pipe, out of a drill bit and up the annulus comprising, measuring the lag time, by inserting a marker in the drill pipe, and deriving a relationship between measured pump strokes, pump pressure and fluid velocity in the annulus, determining a relationship between pump pressure and lag time over a range of pump pressures, thereafter continuously measuring pump pressure while drilling and calculating lag time from the relationship previously determined, measuring the depth of the drill bit using the change in the depth measurement for adjusting the calculated lag time, measuring at least one parameter of the drilling fluid flowing out of the annulus, and correlating the measured mud parameter with the calculated lag time and thus to depth.

2. The method of claim 1 including, repeating the steps of claim 1 to determine a new relationship between pump pressure and lag time each time well drilling conditions change sufficiently to obsolete the earlier determined relationship.

3. The method of claim 1 wherein measuring a parameter of the drilling fluid includes measuring the amount of formation gas, rock cuttings and other formation fluids in the drilling fluid.

4. The method of claim 1 wherein a base lag time is determined for one point of lag time measurements and the other lag time measurments for different values of pump pressures are converted to a factor of the base lag time for providing an input to a computer.

5. The method of claim 1 wherein the relationship between pump pressure and lag time over a range of pump pressures is determined by measuring the pump strokes and pump pressure at a plurality of different pump strokes and calculating the lag times at the measured values.

* * * * *